United States Patent [19]

Askeland

[11] Patent Number: 5,056,458

[45] Date of Patent: Oct. 15, 1991

[54] PAINTING SHIELD

[76] Inventor: David R. Askeland, 765 Almond Tree Ct., Dixon, Calif. 95620

[21] Appl. No.: 475,412

[22] Filed: Feb. 5, 1990

[51] Int. Cl.[5] ..... B05C 11/11

[52] U.S. Cl. ..... 118/505; 118/501; 220/8; 248/318; 248/320

[58] Field of Search ..... 118/504, 501, 505; 220/4.03, 8; 427/282; 51/310, 311, 312; 156/71; 248/317, 318, 320

[56] References Cited

U.S. PATENT DOCUMENTS

| | | | |
|---|---|---|---|
| 3,091,218 | 5/1963 | Wilson et al. | 118/505 |
| 3,942,472 | 3/1976 | McAlister | 118/504 |
| 4,005,678 | 2/1977 | O'Toole | 118/505 |
| 4,025,137 | 5/1977 | Wyler | 220/8 |
| 4,193,375 | 3/1980 | Sharland et al. | 118/504 |
| 4,316,545 | 2/1982 | Hartnell | 248/318 |
| 4,564,118 | 1/1986 | Heyer et al. | 220/8 |

FOREIGN PATENT DOCUMENTS

| | | | |
|---|---|---|---|
| 625369 | 4/1927 | France | 220/8 |

*Primary Examiner*—Richard V. Fisher
*Assistant Examiner*—Brenda Lamb
*Attorney, Agent, or Firm*—Leon Gilden

[57] ABSTRACT

An apparatus includes a first tray slidably received within a second tray, wherein the first tray and the second tray each are formed with a planar floor and upstanding flanges orthogonally and coextensively mounted to spaced parallel edges of each floor. Each floor includes an enclosed longitudinally aligned slot, wherein the slots overlie each other when the first shield is slidably received within the second shield to fixedly position the first shield relative to the second shield in an adjustable manner. Each shield includes at its forward end a first and second "U" shaped recess, the recesses aligned relative to one another to complementarily receive door framework contours of opposed door frames to provide a shield overlying an interface between room portions directed through a portal. A modification of the instant invention includes suspension hooks mounted to flexible lines, wherein the lines include spools to adjust the length of the lines to provide shielding in an adjustable manner relative to an upper end of the associated portal. A further modification includes flexible fingers aligned and parallel to one another formed with the aforenoted aligned slots mounted to forward ends of each of the relatively movable sections to accommodate contour variations within door framework portals.

3 Claims, 4 Drawing Sheets

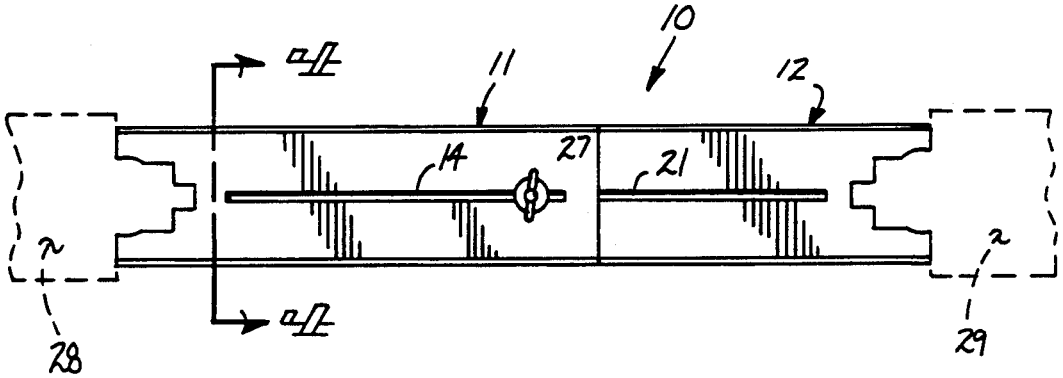
FIG 3
FIG 4
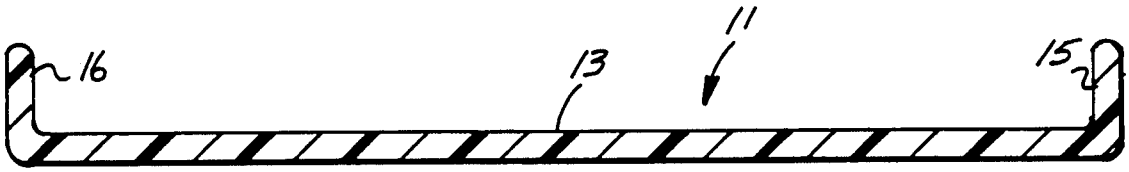

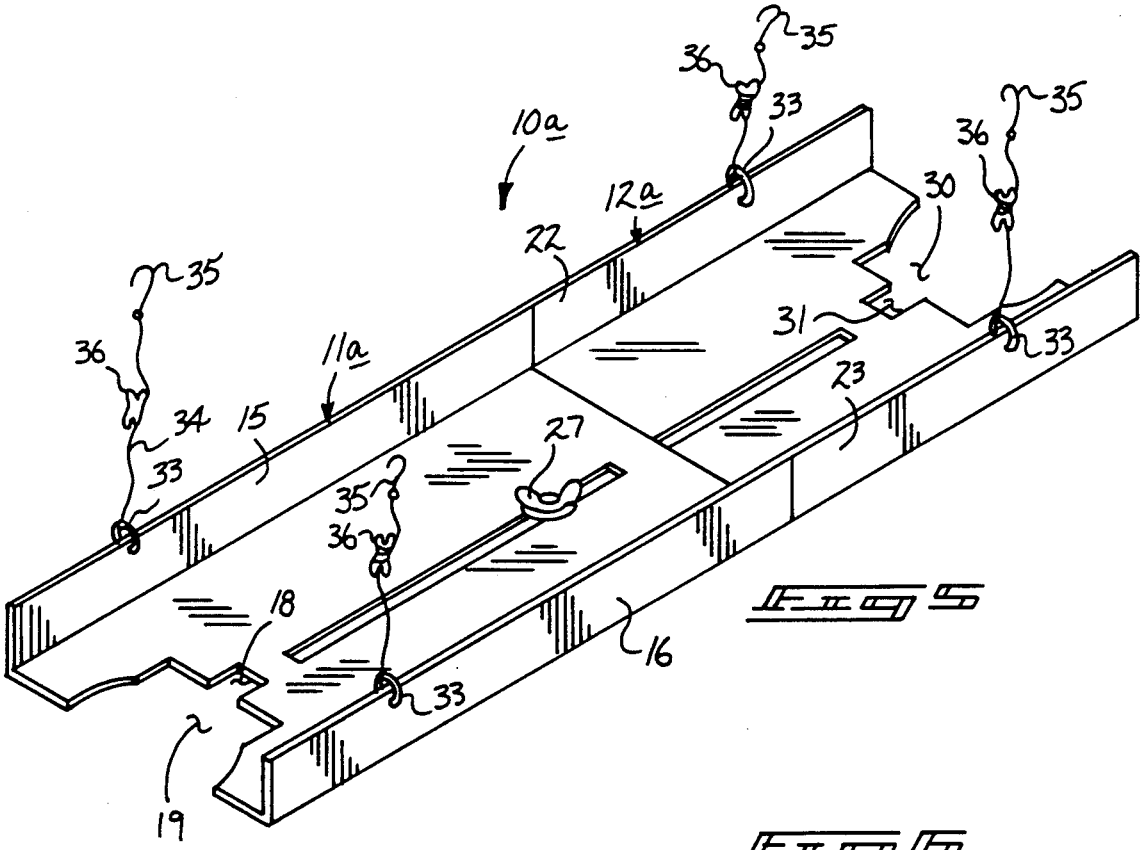
Fig 5
Fig 6
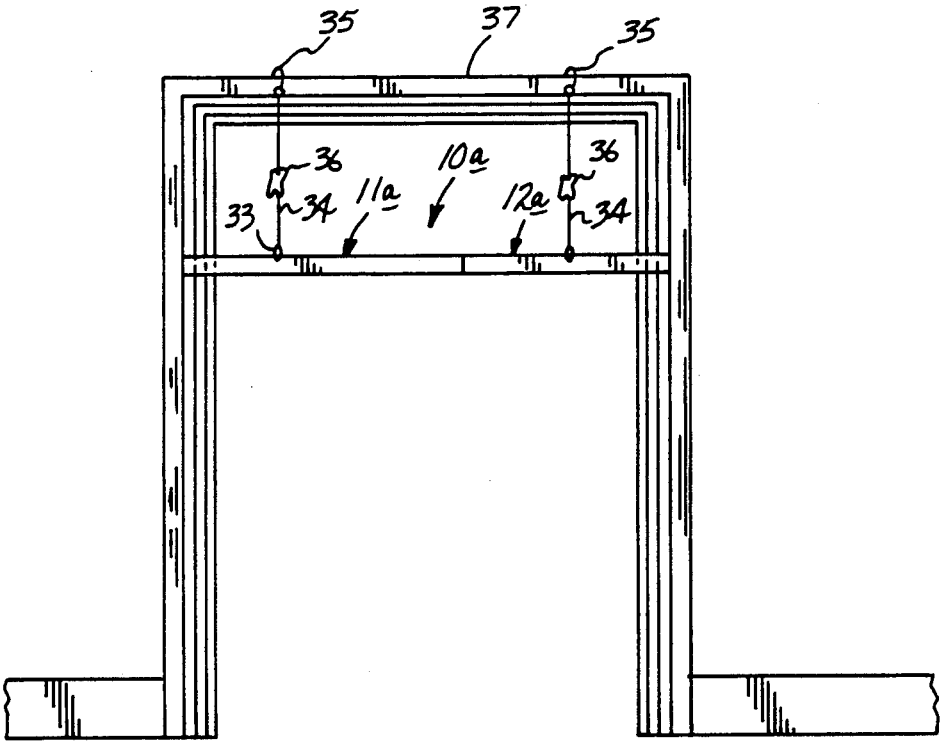

10
12
20
21
23
27
14
13
38
11
12
11
39
40
40
41

PAINTING SHIELD

BACKGROUND OF THE INVENTION

1. Field of the Invention

The field of invention relates to painting shields, and more particularly pertains to a new and improved painting shield wherein the same is adjustably positioned between opposed vertical portions of a door framework defining a portal.

2. Description of the Prior Art

Painting shields of various types are utilized in the prior art to afford protection to various surfaces where application of paint is not directed. Examples of the prior art include U.S. Pat. No. 4,085,703 to Glowacki wherein an example includes a bifurcated plate mounted to a rod to underlie "U" shaped structures for example and utilizing other configurations, such as "L" shape and the like, to provide shielding of various underlying surfaces during a painting procedure.

U.S. Pat. No. 4,051,808 to Trupp sets forth a painting shield for shielding carpet edging and the like during the painting of walls defined as a generally "S" shaped member to overlie a carpet length and afford protection thereto.

U.S. Pat. No. 4,383,496 to Shotwell sets forth a painting guide including an elongate frame removably mounted by a pair of "L" shaped brackets repositionable by various linkage to adjust positioning of the guide relative to a framework of an associated window.

U.S Pat. No. 4,248,914 to McClane sets forth a paint shield comprising a large flexible blade attached to a handle wherein the blade is positioned at a forward edge thereof to a corner edge of a surface to be painted, and by exerting force on the handle, the blade is flexed with respect to the surface to be painted to provide a shield under the blade.

U.S. Pat. No. 4,357,898 to Fehrenbacher sets forth a shield for protecting nap or pile of carpeting defined as an elongate shield with a cross-sectional configuration of a generally "U" shaped configuration, with a forward sloping leg to overlie and compress carpet nap adjacent a surface to be painted.

As such, it may be appreciated that there is a continuing need for a new and improved painting shield which addresses both the problems of adjustability and accommodating floor surface areas between adjacent portal frameworks and in this respect, the present invention substantially fulfills this need.

SUMMARY OF THE INVENTION

In view of the foregoing disadvantages inherent in the known types of painting shields now present in the prior art, the present invention provides a painting shield which is longitudinally adjustable to accommodate various widths of portal frameworks to afford protection thereunder. As such, the general purpose of the present invention, which will be described subsequently in greater detail, is to provide a new and improved painting shield which has all the advantages of the prior art painting shields and none of the disadvantages.

To attain this, the present invention comprises an apparatus including a first tray slidably received within a second tray, wherein the first tray and the second tray each are formed with a planar floor and upstanding flanges orthogonally and coextensively mounted to spaced parallel edged of each floor. Each floor includes an enclosed longitudinally aligned slot, wherein the slots overlie each other when the first shield is slidably received within the second shield to fixedly position the first shield relative to the second shield in an adjustable manner. Each shield includes at its forward end a first and second "U" shaped recess, the recesses aligned relative to one another to complementarily receive door framework contours of opposed door frames to provide shield overlying an interface between room portions directed through a portal. A modification of the instant invention includes suspension hooks mounted to flexible lines, wherein the lines include spools to adjust the length of the lines to provide shielding in an adjustable manner relative to an upper end of the associated portal. A further modification includes flexible fingers aligned and parallel to one another formed with the aforenoted aligned slots mounted to forward ends of each of the relatively movable sections to accommodate contour variations within door framework portals.

My invention resides not in any one of these features per se, but rather in the particular combination of all of them herein disclosed and claimed and it is distinguished from the prior art in this particular combination of all of its structures for the functions specified.

There has thus been outline, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purposes of the foregoing abstract is of enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved painting shield which has all the advantages of the prior art painting shields and none of the disadvantages.

It is another object of the present invention to provide a new and improved painting shield which may be easily and efficiently manufactured and marketed.

It is a further object of the present invention to provide a new and improved painting shield which is of a durable and reliable construction.

An even further object of the present invention is to provide a new and improved painting shield which is susceptible of a low cost of manufacture with regard to both materials and labor, and which accordingly is then susceptible of low prices of sale to the consuming public, thereby making such painting shield economically available to the buying public.

Still yet another object of the present invention is to provide a new and improved painting shield which provides in the apparatuses and methods of the prior art some of the advantages thereof, while simultaneously overcoming some of the disadvantages normally associated therewith.

Still another object of the present invention is to provide a new and improved painting shield wherein the same is longitudinally adjustable to overlie a floor surface between vertical portions of a door framework and may further include flexible end portions for accommodating irregularities in such framework.

These togehter with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a top orthographic view of the instant invention in structural association between spaced door framework structures.

FIG. 4 is an orthographic cross-sectional view taken along the lines 4—4 of FIG. 3 in the direction indicated by the arrows.

FIG. 5 is an isometric illustration of a modified painting shield.

FIG. 6 is an orthographic view taken in elevation of the modified painting shield of FIG. 5 in position with an associated door framework.

DESCRIPTION OF THE PREFERRED EMBODIMENT

Figures 1, 2:
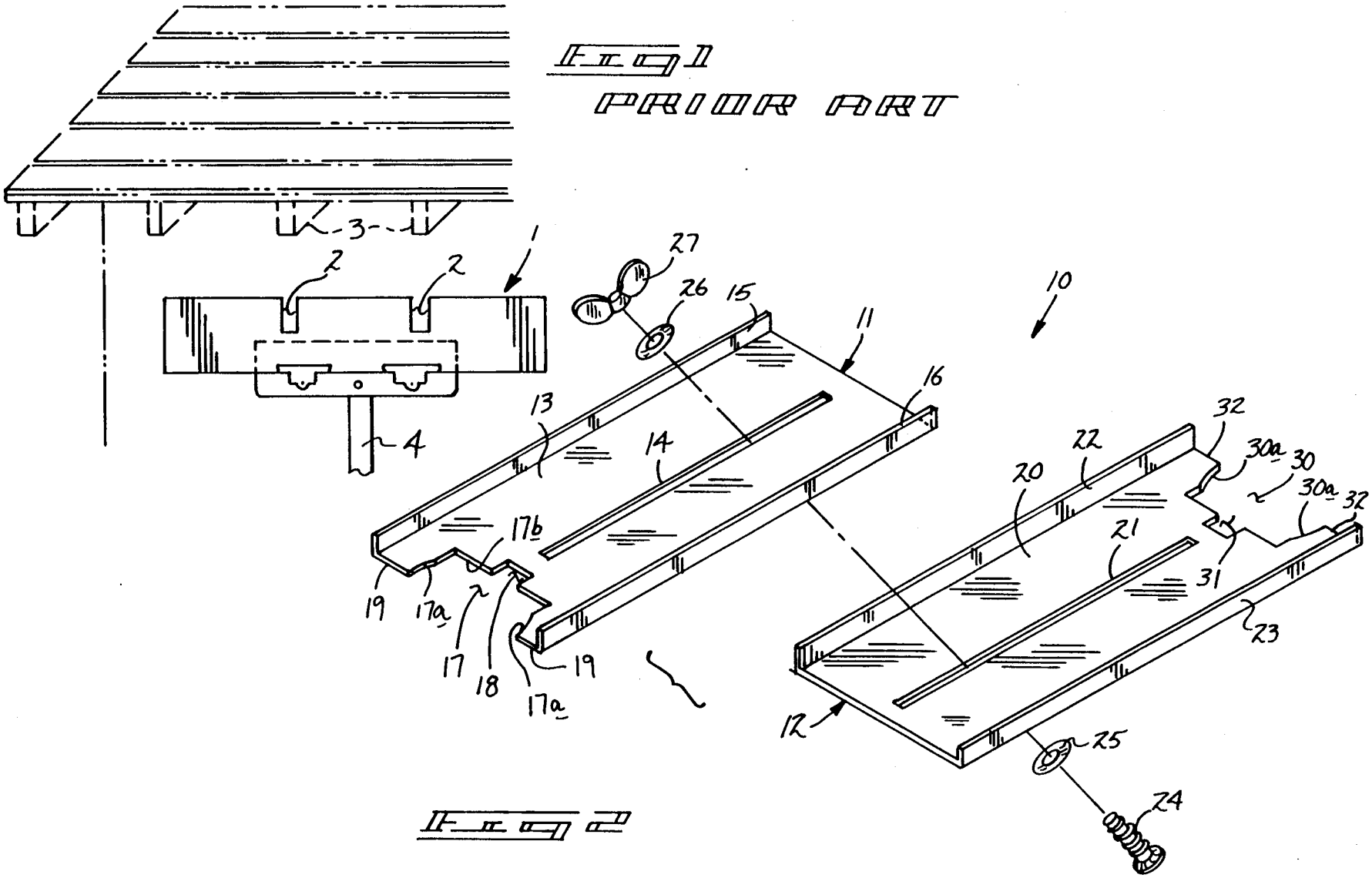
FIG. 1 PRIOR ART
FIG. 1 is an orthographic illustration of a prior art painting shield.
FIG. 2 is an isometric, exploded view of the instant invention.

With reference now to the drawings, and in particular to FIGS. 1 to 8 thereof, a new and improved painting shield embodying the principles and concepts of the present invention and generally designated by the reference numerals 10 and 10*a* will be described.

Reference to FIG. 1 illustrates a typical prior art shield 1 provided with bifurcated openings 2 to accommodate a particular configuration, wherein this case involves the overlying of the roof trusses 3 to afford shielding to side surfaces of the associated structure. The shield 1 is removably mounted upon the support handle 4.

More specifically, the painting shield 10 of the instant invention essentially comprisesf a first longitudinally aligned tray 11 slidably receivable within a sound longitudinally aligned tray 12. The first tray 11 includes a first rectangular planar base 13, with a first medially positioned and longitudinally aligned enclosed slot 14 positioned and directed through the base 13. A first and second respective flange 15 and 16 is orthogonally oriented and coextensive with each side edge of the base 13 to encompass spillage directed onto the upper surface of the base 13. A first "U" shaped recess 17 is formed through a forward edge of the base 13 and includes a second "U" shaped recess 18 directed medially through a base edge 17*b* between spaced side edges 17*a*. The second "U" shaped recess 18 is of a lesser width than that defined by the first recess 17*a*, wherein forward aligned abutment edges 19 are orthogonally aligned relative to the flanges 15 and 16. Similarly the second tray 12 is of a like configuration provided with a second planar base 20 formed with a second longitudinally aligned slot 21 positioned medially and longitudinally of the second base 20 and formed with its respective first and second further flanges 22 and 23 orthogonally formed to and coextensive with side edges of the base 20. A threaded fastener 24 is receivable through the respective slots 21 and 14, wherein the trays 11 and 12 are mounted together with a first and second washer 25 and 26 sandwiching the trays therebetween with a wing nut 27 enabling manual securement and positioning of the first tray relative to the second tray in a manner as illustrated in FIG. 3 for example, illustrating the shield 10 mounted upon a floor surface between a left and right respective door frame 28 and 29 formed with molding that is complementarily received within the respective "U" shaped recesses 17–18, and 30–31 of the respective trays 11 and 12. The recesses 30 and 31 formed within the second tray 12 are also of a "U" shaped and aligned configuration relative to one another in the manner similar to that as illustrated and discussed per tray 11. It is contemplated that the side edges or legs 30*a* of the further recess 30 of the second tray 12 be of a greater length than that of the side edges 17*a* of the first "U" shaped recess 17 to accommodate door frames of a reduces width. The trays 11 and 12 are each formed of a semi-rigid polymeric material to accommodate deflection and irregularities within a floor surface and door frame contours.

FIG. 5 is illustrative of a modified painting shield 10*a* formed with a first and second tray 11*a* and 12*a* of a like configuration to that defined by the painting shield 10, illustrated in FIG. 2. Additionally, the modified painting shield 10*a* includes plural pairs of rigid "O" rings 33 pivotally mounted and received within through-extending apertures formed within the upstanding flanges 15 and 16, and 22 and 23, as illustrated in FIG. 5. The rings are aligned within the respective second recesses 18 and 31 to mount the rings forwardly of the tray to properly balance the tray in use. The "O" rings 33 include a finite length of flexible line 34 wound about a spool 36 to effectively adjust the length of the flexible line 34 associated with each "O" ring 33, with each flexible line 34 formed with a hook 35 mounted at its remote terminal end. The hooks 35 enable securement of the apparatusf 10*a* within a door frame, as illustrated in FIG. 6, and enable a gradual lowering of the device during a painting procedure to enable painting at an upper end of a door frame and subsequently lower the device as painting progresses downwardly thereof.

Figures 7, 8:
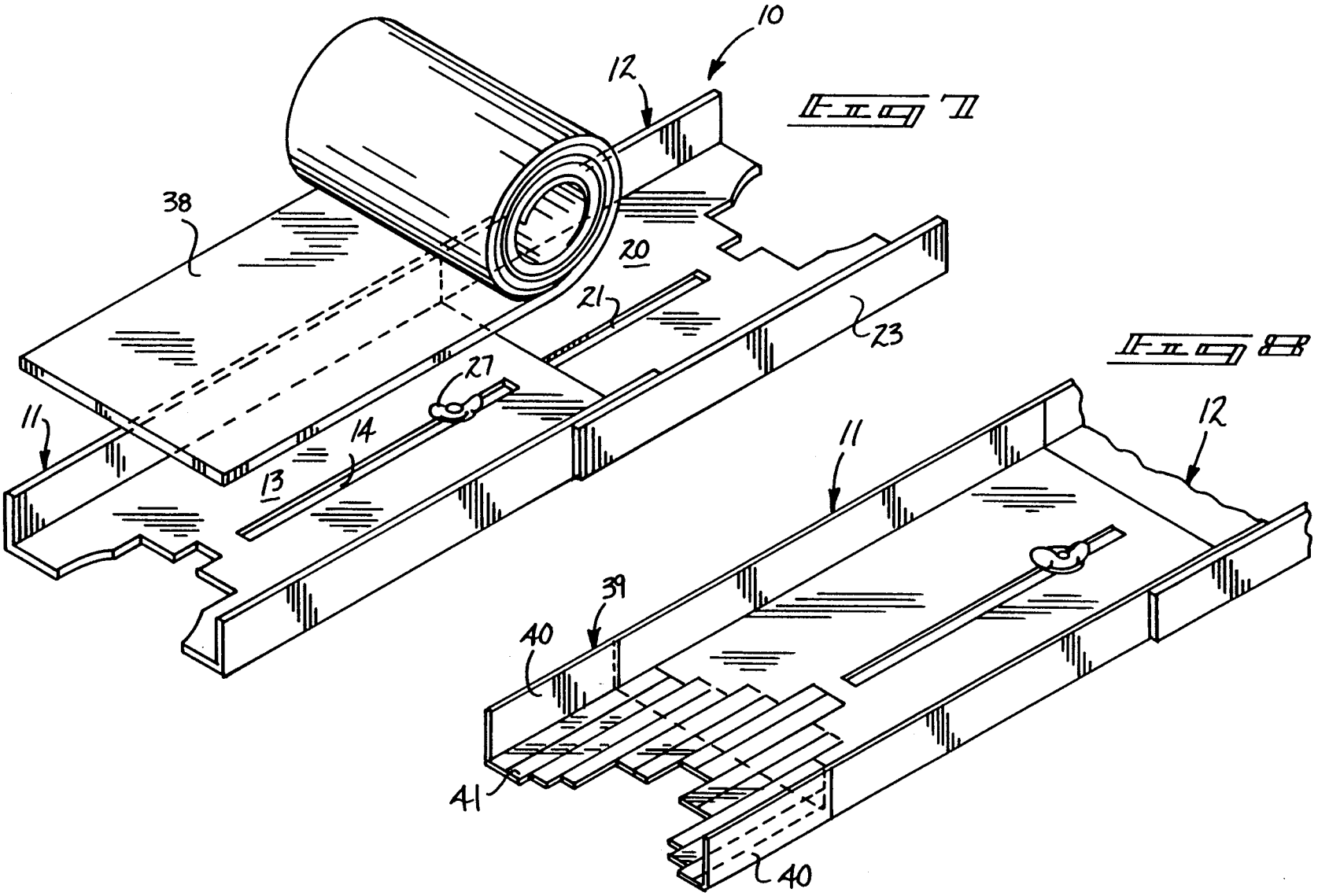
FIG. 7 is an isometric illustration of the painting shield in association with a removable liner.
FIG. 8 is an isometric illustration of the painting shield in association with an extension member to accommodate irregularities in framework contours.

FIG. 7 illustrates the painting shield 10 in use with a replaceable roll of flexible liner mounted between the upstanding flanges of the device and defined by a width substantially equal to a predetermined width between the flanges to maintain the apparatus 10, wherein the liner 38 is formed further of an absorbent material to more readily accommodate greater quantities of paint that may be inadvertently spilled and deposited onto the shield during use.

FIG. 8 illustrates the apparatus 10 with the first and second trays 11 and 12 provided with an extension member 39. The extension member 39 is formed with spaced lateral flange extensions 40 securable in alignment with the upstanding flanges of the associated trays 11 and 12 and formed with a matrix of parallel, flexible fingers 41 securable to an upper surface and forward edge of the associated trays 11 and 12. The flexible fingers at their forward edges define a first and second respective "U" shaped extension recess 42 and 43 to accommodate the door frame in a more readily adjustable manner, as opposed to that of the apparatus as illustrated in FIG. 2 and 5 for example.

As to the manner of usuage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A painting shield positionable between vertically aligned and spaced door frames defining a portal opening therebetween, wherein the door frames each include an irregular confronting surface relative to one another, and wherein the shield comprises, a first longitudinally aligned tray slidably receivable within a second longitudinally aligned tray, the first and the second tray each including a respective first planar base and a second planar base, wherein the first planar base is slidably received overlying the second planar base, and a first enclosed slot formed through the first planar base formed medially and longitudinally aligned thereof within the first tray and aligned with a second enclosed slot formed through the second planar base in the second tray and longitudinally and medially aligned through the second planar base, and fastening means directed through the first and second slots to secure the first and second trays together, and wherein each planar base includes a first and second flange coextensive with and orthogonally mounted to parallel side edge portions of each of the respective first and second planar bases, and the first planar base formed with a forward edge, and the second planar base with a further forward edge, and at least one recess formed through the forward edge and further edge of the first respective first and second planar bases, and wherein the recess formed through the forward edge of the first planar base is of a generally "U" shaped configuration and further includes side edges and a base edge with a further "U" shaped recess medially formed of and directed through the base edge, and the further forward edge of the second planar base includes a further "U" shaped recess with further side edges and a further base edge defining the further "U" shaped recess with a yet further "U" shaped recess formed medially through the yet further base edge of the further "U" shaped recess, and the recesses formed through the first and second planar bases aligned relative to one another when the first and second trays are secured together, and wherein the flanges of the first and second planar bases each include a rigid "O" ring pivotally mounted therethrough, each of the "O" rings aligned with one another and including a flexible line directed therefrom, the flexible line further including a hook member mounted at a forward terminal end of each flexible line, and wherein each flexible line further includes a spool member thereof with the flexible line wound about the spool member to provide adjustment of an effective length defined by each flexible line to adjustably suspend the painting shield relative to an overlying support surface of the door frames.

2. A painting shield as set forth in claim 1 further including an absorbent flexible liner removably mounted between the flanges and coextensive with the first and second planar bases when the first and second planar bases are secured together.

3. A painting shield as set forth in claim 2 further including an extension member mounted to each forward edge of the first and second planar base, the extension member including a plurality of extension flanges securable to the flanges of each planar base and securable to the foward edge of each planar base, with the extension flanges including a series of aligned parallel flexible fingers formed between the extension flanges, wherein the fingers include a first and second recess formed between the extension flanges through a surface defined by the flexible fingers to adjustably accommodate the irregular confronting surfaces of the door frames.

* * * * *